US011918091B2

(12) United States Patent
Yung

(10) Patent No.: US 11,918,091 B2
(45) Date of Patent: Mar. 5, 2024

(54) UMBRELLA WITH GROUND ENGAGEMENT STRUCTURE

(71) Applicant: Jasper Yung, West Bloomfield, MI (US)

(72) Inventor: Jasper Yung, West Bloomfield, MI (US)

( * ) Notice: Subject to any disclaimer, the term of this patent is extended or adjusted under 35 U.S.C. 154(b) by 71 days.

(21) Appl. No.: 17/561,079

(22) Filed: Dec. 23, 2021

(65) Prior Publication Data

US 2023/0200506 A1 Jun. 29, 2023

(51) Int. Cl.
*A45B 25/00* (2006.01)
*A45B 23/00* (2006.01)
*A45B 25/02* (2006.01)

(52) U.S. Cl.
CPC ..... *A45B 25/02* (2013.01); *A45B 23/00* (2013.01); *A45B 2023/0012* (2013.01)

(58) Field of Classification Search
CPC ..... A45B 2023/0012; E04H 12/2215; E04H 12/2246
See application file for complete search history.

(56) References Cited

U.S. PATENT DOCUMENTS 3,120,238 A * 2/1964 Glatz ..... A45B 23/00 135/21
5,636,944 A * 6/1997 Buttimore ..... E01F 9/685 52/298
7,007,703 B2 * 3/2006 Brooks, III ..... A45B 3/00 52/157
8,082,934 B1 * 12/2011 Kucinski ..... E04H 12/2238 248/530
8,297,295 B2 10/2012 Banerjee
8,371,319 B2 * 2/2013 Meibos ..... A45F 3/44 248/156
9,232,836 B1 * 1/2016 Zaccaro ..... A45B 23/00
10,344,496 B1 * 7/2019 Cefalo ..... E04H 12/2215
11,377,866 B1 * 7/2022 Conlon ..... A45B 23/00
2006/0016950 A1 * 1/2006 Bright ..... E04H 12/2246 248/346.03
2010/0154848 A1 * 6/2010 Meibos ..... A45B 23/00 248/156
2011/0297197 A1 * 12/2011 Kucinski ..... E04H 12/2238 248/530
2015/0013734 A1 * 1/2015 Krystopher ..... E04H 12/2246 135/16

OTHER PUBLICATIONS

Internet Page: Amazon; DUUDO Beach Umbrella Sand Anchor, with 5-Spiral Design One Size Fits All Umbrellas to Resist Strong Winds, White Umbrella Holder (1 Pack); 5 pages, https://www.amazon.com/DUUDO-Umbrella-Anchor-Strong-Holder/dp/B07CWTFVWK/ref=mp_s_a_1_4?keywords=beach+umbrella+drill&qid=1640638215&sr=8-4.

* cited by examiner

*Primary Examiner* — Noah Chandler Hawk
(74) *Attorney, Agent, or Firm* — Lewis Roca Rothgerber Christie LLP

(57) ABSTRACT

An umbrella includes: a pole part having a first end, a second end opposite the first end, and a pole axis extending through the first end and the second end; an umbrella part at the first end; and a ground engagement structure extending from the second end for engaging a ground. The ground engagement structure includes: a material shifting structure extending radially relative to the pole part; and a material receiving groove adjacent to the material shifting structure.

7 Claims, 12 Drawing Sheets

UMBRELLA WITH GROUND ENGAGEMENT STRUCTURE

BACKGROUND

1. Field

Aspects of one or more embodiments of the present disclosure relate to an umbrella, and more particularly, to an umbrella including a ground engagement structure for implanting in various terrains.

2. Description of Related Art

According to the American Cancer Society, when engaging in outdoor activities, especially during the summer months and at locations of constant sun-exposed climates, people are encouraged to cover as much as the unprotected portion of the exposed skin as possible to prevent promotion of the possible development of skin cancer and/or other forms of heat-exposed injuries (e.g., heat stroke, sun-burns, dehydration, and/or the like). Thus, portable umbrellas that may be installed into the ground to provide shade have become popular. However, the installation and placement of these umbrellas have posed various challenges, especially in order to obtain a deeper based foundation in a shifting terrain, which may be exacerbated as some foundations may be harder due to moisture, rocks, or other forms of obstacles (e.g., vegetation, roots, and/or the like) that may be present.

The above information disclosed in this Background section is for enhancement of understanding of the background of the present disclosure, and therefore, it may contain information that does not constitute prior art.

SUMMARY

One or more embodiments of the present disclosure are directed to an umbrella having a ground engagement structure to allow for ease of placement and installation of the umbrella in various terrains.

According to one or more embodiments of the present disclosure, an umbrella includes: a pole part having a first end, a second end opposite the first end, and a pole axis extending through the first end and the second end; an umbrella part at the first end; and a ground engagement structure extending from the second end for engaging a ground. The ground engagement structures includes: a material shifting structure extending radially relative to the pole part; and a material receiving groove adjacent to the material shifting structure.

In some embodiments, the material shifting structure may be a threaded structure extending radially relative to the pole part, and the material receiving groove may be a channel extending between threads of the threaded structure.

In some embodiments, widths of the threads may increase towards the pole part from an engagement end of the ground engagement structure.

In some embodiments, widths of the threads may be constant along a length of the material shifting structure.

In some embodiments, the material shifting structure may include a plurality of arms that extend radially relative to the pole part, and the arms may be spaced apart from one another by the material receiving groove.

In some embodiments, the arms may be bent or curved.

In some embodiments, the material shifting structure may include: an upper surface facing the pole part; a lower curved surface opposite the upper surface, and defining an engagement end; and a lip connecting the upper surface to the lower surface. The lower curved surface may have a width that increases from the engagement end towards the upper surface.

In some embodiments, the material receiving groove may be a channel extending through the lower curved surface and the upper surface of the material shifting structure.

In some embodiments, the pole part may include a first pole part including the umbrella part and a second pole part including the ground engagement structure.

In some embodiments, the first pole part may be slidably connected with the second pole part.

In some embodiments, the first pole part may include the first end of the pole part, a third end opposite the first end, and an elongated body extending between the first and third ends; the second pole part may include the second end of the pole part, a fourth end opposite the second end, and a tubular body extending between the second and fourth ends; and the third end may be insertable into the fourth end such that at least a portion of the first pole part may be received in the second pole part.

In some embodiments, the umbrella may further include a handle part connected to the pole part.

In some embodiments, the handle part may be hingedly connected to the pole part.

According to one or more embodiments of the present disclosure, an umbrella includes: a pole part having a first end, a second end opposite the first end, and a pole axis extending through the first end and the second end, the pole part including: a first pole part including the first end, a third end opposite the first end, and an elongated body extending between the first and third ends; and a second pole part including the second end, a fourth end opposite the second end, and a tubular body extending between the second and fourth ends; an umbrella part at the first end; and a ground engagement structure extending from the second end for engaging a ground. The ground engagement structure includes: a material shifting structure extending radially relative to the pole part; and a material receiving groove adjacent to the material shifting structure. The third end of the first pole part is insertable into the tubular body via the fourth end of the second pole part.

In some embodiments, the material shifting structure may be a threaded structure extending radially relative to the pole part, and the material receiving groove may be a channel extending between threads of the threaded structure.

In some embodiments, widths of the threads may increase towards the pole part from an engagement end of the ground engagement structure.

In some embodiments, widths of the threads may be constant along a length of the material shifting structure.

In some embodiments, the material shifting structure may include a plurality of arms that extend radially relative to the pole part, and the arms may be spaced apart from one another by the material receiving groove.

In some embodiments, the material shifting structure may include: an upper surface facing the pole part; a lower curved surface opposite the upper surface, and defining an engagement end; and a lip connecting the upper surface to the lower surface, and the lower curved surface may have a width that increases from the engagement end towards the upper surface.

In some embodiments, the material receiving groove may be a channel extending through the lower curved surface and the upper surface of the material shifting structure.

BRIEF DESCRIPTION OF THE DRAWINGS

The above and other aspects and features of the present disclosure will be more clearly understood from the following detailed description of the illustrative, non-limiting embodiments with reference to the accompanying drawings.

DETAILED DESCRIPTION

Figure 1A:
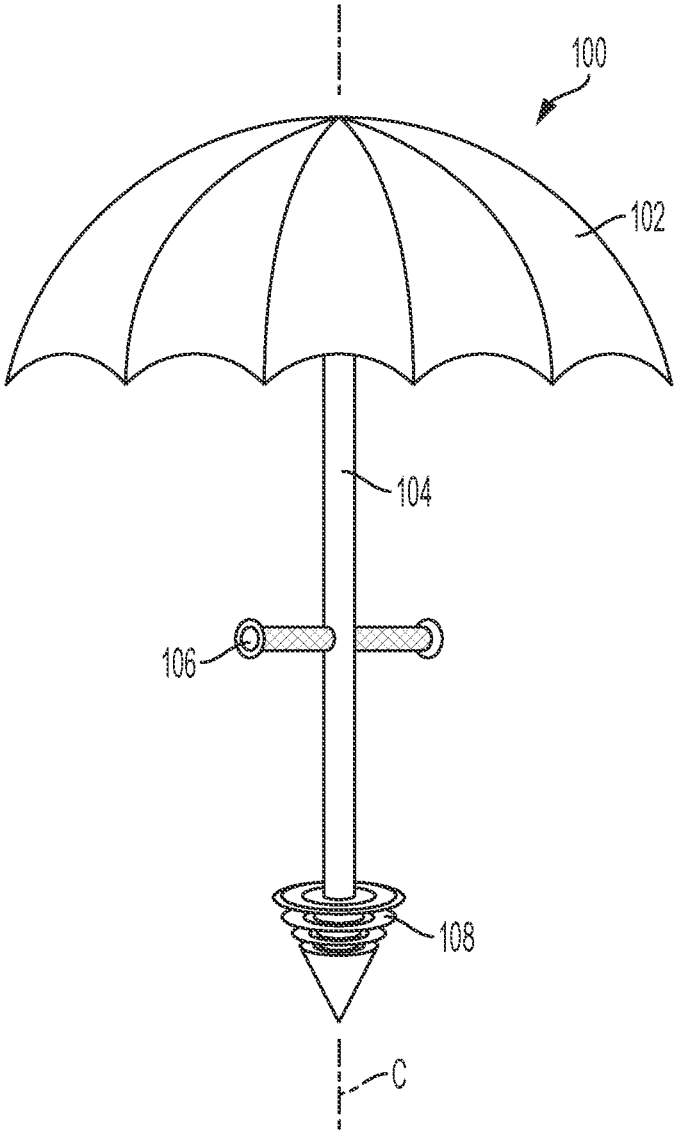
FIG. 1A is a perspective view of an umbrella according to one or more embodiments of the present disclosure.

Hereinafter, embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, redundant description thereof may not be repeated.

When a certain embodiment may be implemented differently, a specific process order may be different from the described order. For example, two consecutively described processes may be performed at the same or substantially at the same time, or may be performed in an order opposite to the described order.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

As used herein, a first direction, a second direction, and a third direction are not limited to the three axes of the rectangular coordinate system, and may be interpreted in a broader sense. For example, the first direction, the second direction, and the third direction may be perpendicular to or substantially perpendicular to one another, or may represent different directions from each other that are not perpendicular to one another.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. Similarly, when a layer, an area, or an element is referred to as being "electrically connected" to another layer, area, or element, it may be directly electrically connected to the other layer, area, or element, and/or may be indirectly electrically connected with one or more intervening layers, areas, or elements therebetween. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B. Expressions such as "at least one of," when preceding a list of elements, modify the entire list of elements and do not modify the individual elements of the list. For example, the expression "at least one of a, b, or c" indicates only a, only b, only c, both a and b, both a and c, both b and c, all of a, b, and c, or variations thereof.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 1B:
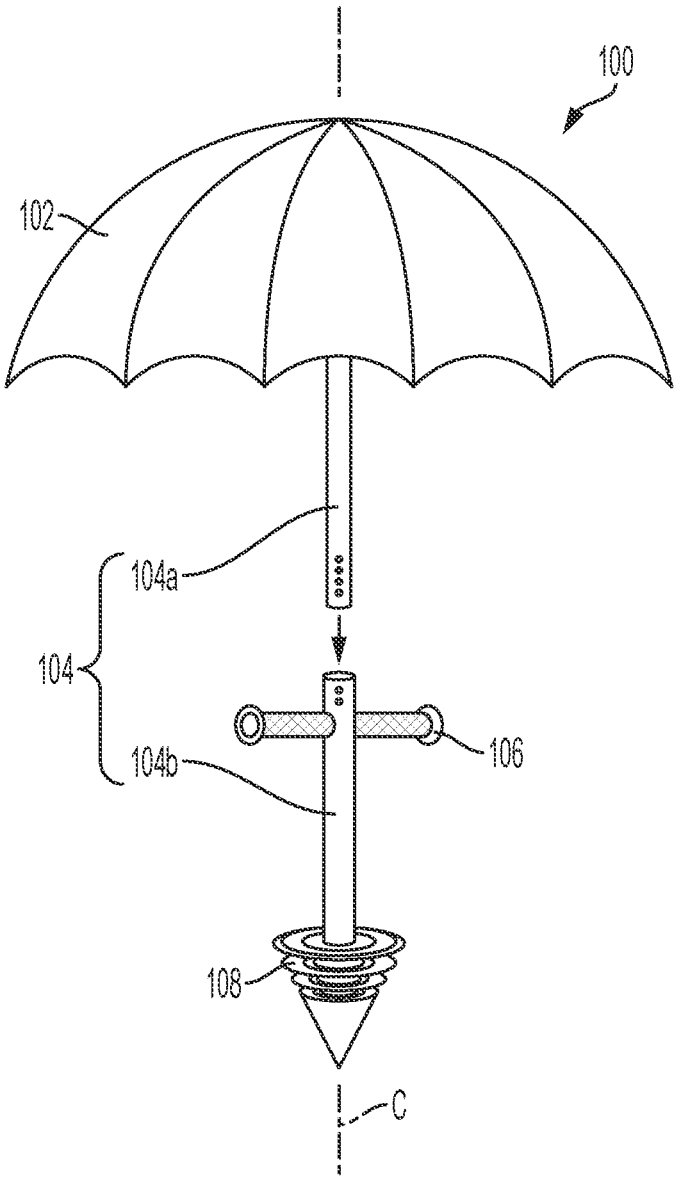
FIG. 1B is a partially exploded perspective view of an umbrella according to one or more embodiments of the present disclosure.

FIG. 1A is a perspective view of an umbrella according to one or more embodiments of the present disclosure. FIG. 1B is a partially exploded perspective view of an umbrella according to one or more embodiments of the present disclosure.

Referring to FIGS. 1A and 1B, an umbrella 100 may include an umbrella part 102, a pole part 104, and a ground engagement structure 108. In some embodiments, the umbrella 100 may further include a handle part 106, but the present disclosure is not limited thereto. The umbrella 100 may have a distal end, a proximal end, and a central axis C extending through the distal and proximal ends. The umbrella part 102 may be located at the distal end, the ground engagement structure 108 may be located at the proximal end, and the pole part 104 may connect the umbrella part 102 to the ground engagement structure 108.

The umbrella part 102 may be attached to an upper portion of the pole part 104 to provide cover and/or shade. The umbrella part 102 may be attached to the upper portion of the pole part 104 using any suitable method known to those skilled in the art, and thus, the present disclosure is not particularly limited to any one method. In some embodiments, the umbrella part 102 may be deployed from a first compressed state to a second expanded state. For example, the umbrella part 102 may be deployed from a first compressed state in which end portions of the umbrella part 102 are closer to the pole part 104 to the second expanded state with respect to the pole part 104 in which the end portions are farther from the pole part 104 as shown in FIGS. 1A and 1B. However, the present disclosure is not limited thereto. For example, in other embodiments, the umbrella part 102 may be configured to be in only one state (e.g., the expanded state), or more than the two states described above.

The pole part 104 may extend in a first direction, and may include a first end (e.g., an upper end or a distal end), a second end (e.g., a lower end or a proximal end), and an elongated section between the first and second ends. The central axis C (also referred to as a pole axis) may extend through the first and second ends of the pole part 104. The umbrella part 102 may be connected to the first end (e.g., also referred to hereinafter as an umbrella part end) of the pole part 104. The ground engagement structure 108 may be connected to the second end (e.g., also referred to hereinafter as a ground engagement end) of the pole part 104, or may be formed on or with at least a portion of the pole part 104 at the ground engagement end. The pole part 104 may include (e.g., may be formed of) a suitable material that has a sufficient stiffness in order to enable the umbrella 100 to be implanted into the ground. For example, the pole part 104 may include (e.g., may be formed of) a suitable plastic material, metal material, composite material, alloy material, and/or the like. However, the present disclosure is not limited thereto, and the pole part 104 may include (e.g., may be formed of) any suitable material known to those skilled in the art, and thus, the pole part 104 is not limited to any particular material. For convenience of illustration, the figures show that the pole part 104 extends in the first direction, but the present disclosure is not limited thereto. For example, in other embodiments, the pole part 104 may extend in various suitable directions, or may be bendable in one or more directions.

In some embodiments, at a distance from the second end of the pole part 104, the handle part 106 may be connected to or integrally formed on the elongated section of the pole part 106. For example, the handle part 106 may be integrally formed with, welded to, bolted to, screwed to, or otherwise attached at a suitable position along the pole part 104 to enable the user to grasp the handle part 106 in order to rotate the pole part 104 relative to the central axis C, and thus, rotate the ground engagement part 108. In other words, the handle part 106 may provide a hand-hold for a user when implanting the umbrella 100 into the ground. In some embodiments, the handle part 106 may serve as a functional cantilever that assists with a twisting/torque motion to implant the umbrella 100 into a desired depth of a given terrain. For example, this rotational (e.g., centripetal) motion allows for the ground engagement structure 108 to burrow deeper into the ground.

However, the present disclosure is not limited thereto, and in other embodiments, the handle part 106 may be omitted. For example, in other embodiments, instead of the handle part 106, the user may grasp the pole part 104 directly, or the pole part 104 may include a gripper, a bent part, a plurality of protrusions, a plurality of indentations, a non-slip material, a non-slip area, and/or the like at a suitable position along the pole part 104 to assist the user with grasping the pole part 104. While the figures show that the handle part 106 has a bar-type shape extending in a second direction crossing the first direction, the present disclosure is not limited thereto, and the handle 106 may have any suitable shape known to those skilled in the art. Various examples of the handle part 106 will be described in more detail below with reference to FIGS. 3A to 3C.

The ground engagement structure 108 may be formed on at least a portion of the pole part 104 or may be connected to the pole part 104 to facilitate the user with implanting the umbrella 100 into the ground. For example, the ground engagement structure 108 may be integrally formed with at least a portion of the pole part 104 adjacent to and/or including the second end of the pole part 104, or may be removably connected to, welded to, bolted to, screwed on, or otherwise attached to the pole part 104 at the second end. The ground engagement structure 108 may be rotated according to a rotational force applied to the pole part 104 (and/or via the handle part 106) to burrow deeper into the ground. An opposite rotational force applied to the pole part 104 (and/or via the handle part 106) may cause the ground engagement structure 108 to rotate in an opposite direction to be retracted or released from the ground. Various examples of the ground engagement structure 104 will be described in more detail below with reference to FIGS. 4A to 4E.

In some embodiments, as shown in FIG. 1B, the pole part 104 may include a first pole part 104*a* including the first end (e.g., the umbrella part end) of the pole part 104, and a second pole part 104*b* including the second end (e.g., the ground engagement end) of the pole part 104. In other words, the first pole part 104*a* may include the umbrella part 102, and the second pole part 104*b* may include the ground engagement structure 108. In this case, the first pole part 104*a* may be connected to the second pole part 104*b* at a connection portion along the elongated section of the pole part 104, such that a height of the umbrella 100 may be adjusted by adjusting a length of the elongated section of the pole part 104. For example, the first pole part 104*a* and the second pole part 104*b* may slidably engage each other to adjust the length of the elongated section of the pole part 104, but the present disclosure is not limited thereto.

In some embodiments, a substantial length of the first pole part 104*a* may be received in the second pole part 104*b* to reduce an overall length of the umbrella 100, and to increase the portability of the umbrella 102. For example, an end (e.g., a third end 201 in FIGS. 2A and 2B) of the first pole part 104*a* opposite to the umbrella part end (e.g., the first end) may be received in an end (e.g., a fourth end 203 in FIGS. 2A and 2B) of the second pole part 104*b* opposite to the ground engagement end (e.g., the second end), and may be movable (e.g., may be slidable) towards the ground engagement end within the second pole part 104*b* to be adjacent to the ground engagement end. Accordingly, for example, when the umbrella 100 is not in use, a substantial length of the first pole part 104*a* may be compacted (e.g., retracted or otherwise compressed) into the second pole part 104*b* to increase ease of portability of the umbrella 100.

In some embodiments, the first pole part 104*a* may be detachably connected to the second pole part 104*b*. In this case, ease of installation of the umbrella 100 may be improved. For example, the second pole part 104*b* including the ground engagement structure 108 may be first implanted into the ground, and thereafter, the first pole part 104*a* including the umbrella part 102 may be connected to the second pole part 104*b*. Accordingly, the umbrella part 102 may not pose an obstacle (e.g., may be out of the way) when the user applies a rotational force to rotate the ground engagement structure 108 for implanting in the ground. However, the present disclosure is not limited thereto, and in other embodiments, the pole part 104 may be a unitary pole part 104, for example, as shown in FIG. 1A, or the first pole part 104*a* and the second pole part 104*b* may be connected to each other without being detachable from each other.

Figure 2A:
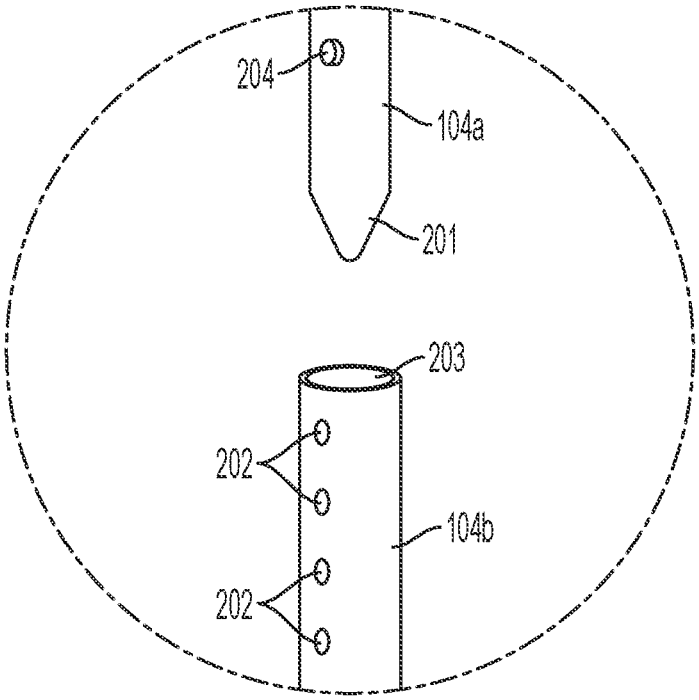
FIGS. 2A-2B are partial views of a portion of the umbrella shown in FIG. 1B according to one or more embodiments of the present disclosure.
Figure 2B:
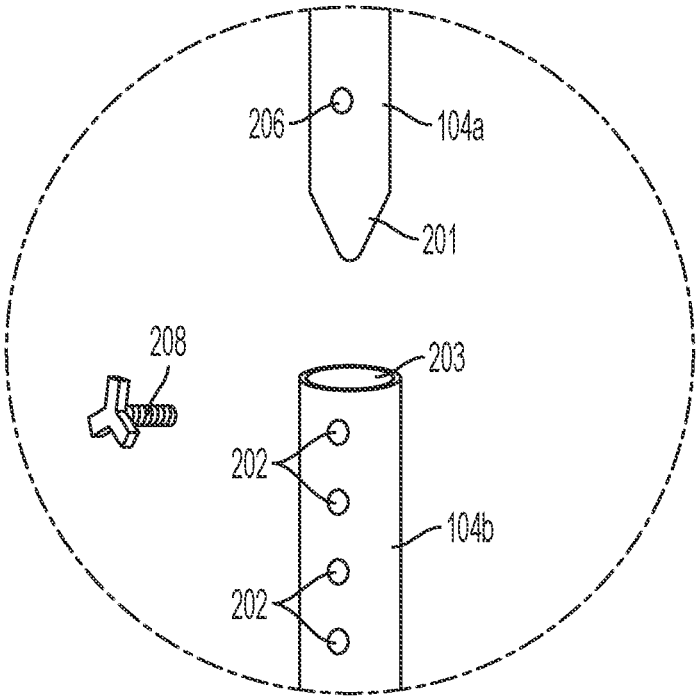

FIGS. 2A-2B are partial views of a portion of the umbrella shown in FIG. 1B according to one or more embodiments of the present disclosure. In more detail, FIGS. 2A and 2B are partial views illustrating a connection portion of the pole part 104 shown in FIG. 1B.

Referring to FIGS. 2A and 2B, in some embodiments, the pole part 104 may include the first pole part 104*a* including the umbrella part 102, and the second pole part 104*b* including the ground engagement structure 108. In some embodiments, the first pole part 104*a* and the second pole part 104*b* may be slidably connected to each other at the connection portion of the pole part 104. For example, in some embodiments, the first pole part 104*a* may include a third end 201 opposite to the umbrella part end, an elongated body between the umbrella part end and the third end 201, and a stop engagement structure 204 or 206 at (e.g., in or on) the elongated body at a distance from the third end 201. The second pole part 104*b* may include a fourth end 203 opposite to the ground engagement end, a tubular body between the ground engagement end and the fourth end 203, and one or more stops 202 along the tubular body at a distance from the fourth end 203.

Accordingly, in some embodiments, the third end 201 of the first pole part 104*a* may be insertably received into the tubular body of the second pole part 104*b* through the fourth end 203. For example, in some embodiments, a width (or a diameter) of at least a portion of the first pole part 104*a* may be smaller than a width or a diameter of the second pole part 104*b* to enable the first pole part 104*a* to be slidably received in the second pole part 104*b*. In some embodiments, the third end 201 of the first pole part 104*a* may be tapered to allow for ease of insertion into the fourth end 203 of the second pole part 104*b*, but the preset disclosure is not limited thereto. In some embodiments, the elongated body of the first pole part 104*a* may also be tubular or substantially tubular, but the present disclosure is not limited thereto.

While the first pole part 104*a* is described as being inserted into the second pole part 104*b*, the present disclosure is not limited thereto, and in other embodiments, the second pole part 104*b* may be inserted into the first pole part 104*a* with appropriate modifications as would be understood by those having ordinary skill in the art. However, for convenience of illustration and description, the first pole part 104*a* and the second pole part 104*b* will be described in more detail hereinafter with the first pole part 104*a* being insertable into the second pole part 104*b*, but the present disclosure is not limited thereto.

The stop engagement structure 204 and 206 of the first pole part 104*a* may engage with at least one of the stops 202 of the second pole part 104*b*. For example, as shown in FIG. 2A, the stop engagement structure 204 may be implemented as a spring-loaded protrusion or button member 204 that protrudes from a surface of the first pole part 104*a* to engage one or more of the stops 202 of the second pole part 104*b*, which may be implemented as a hole or opening 202 along the tubular body of the second pole part 104*b*, such that the first pole part 104*a* may be fixed relative to the second pole part 104*b*.

As another example, as shown in FIG. 2B, the stop engagement structure 206 may be implemented as a hole or opening 206 along the elongated body of the first pole part 104*a* to engage with one or more of the holes or openings 202 of the second pole part 104*b*. For example, the hole or opening 206 of the first pole part 104*a* may be aligned with one of the holes or openings 202 of the second pole part 104*b*, and an engagement member 208, for example, such as a screw, may be inserted into the holes or openings 202 and 206 to fix the first pole part 104*a* relative to the second pole part 104*b*.

As shown in FIGS. 2A and 2B, in some embodiments, the one or more stops 202 of the second pole part 104*b* may include a plurality of stops 202 that are spaced apart from each other along a length of the second pole part 104*b*. In this case, a length of the pole part 104 (and thus, an overall height of the umbrella 100) may be variously adjusted by engaging different ones of the plurality of stops 202. In some embodiments, the second pole part 104*b* may further include a stop formed at or near (e.g., adjacent to) the ground engagement end, such that the stop engagement structure 204 and 206 of the first pole part 104*a* may engage with the stop formed at or near the ground engagement end. In this case, the first pole part 104*a* may be prevented or substantially prevented from sliding along the second pole part 104*b* when a substantial length thereof is compacted (e.g., when retracted or otherwise compressed) into the second pole part 104*b* as described above. However, the present disclosure is not limited thereto, and the stop engagement structure 204 and 206 and/or at least one of the stops 202 may be variously modified or may be omitted as needed or desired.

In some embodiments, when the umbrella 100 further includes the handle part 106, the handle part 106 may be attached at a suitable position along the second pole part 104*b* such that a rotational force applied to the handle part 106 may be applied to the ground engagement structure 108, even when the first pole part 104*a* is detached from the second pole part 104*b*. However, the present disclosure is not limited thereto, and the handle part 106 may be formed on the first pole part 104*a*, or may be omitted as needed or desired.

While FIGS. 2A and 2B illustrate that the first pole part 104*a* and the second pole part 104*b* each have a cylindrical or substantially cylindrical shape, such that each of the first pole part 104*a* and the second pole part 104*b* may have a circular or substantially circular cross-sectional shape, the present disclosure is not limited thereto. For example, in other embodiments, each of the first pole part 104*a* and the second pole part 104*b* may have any suitable cross-sectional mating shape, for example, such as an oval, a polygon (e.g., triangle, square, rectangle, pentagon, hexagon, or the like), an oblong shape, or the like. When the cross-sectional shapes of the first and second pole parts 104*a* and 104*b* are different from the circular shape, the shapes thereof may prevent or substantially prevent the first pole part 104*a* from rotating relative to the second pole part 104*b*, which may facilitate the alignment of the stop engagement structure 204 and 206 with the one or more stops 202, and/or the rotation of the ground engagement structure 108 via a rotational force applied to the first pole part 104*a*.

FIGS. 3A-3D are partial views of a handle part according to one or more embodiments of the present disclosure. The location of the handle part 106 may vary in position being proximal or distal from the umbrella part 102, the ground engagement structure 108, and/or the connecting portion of the pole parts 104*a* and 104*b*. Further, the variation of the height and location of the handle part 106 may allow for better torque/leverage and/or stability when applying greater forces thereon for different ground densities.

For example, in some embodiments, the handle part 106 may allow for increased rotational force that can be applied to the ground engagement structure 108 to facilitate its entrance into various different terrains. In other embodiments, the handle part 106 may be omitted, and/or use of various suitable forms of grips may be utilized. Further, in some embodiments, the use of variable shapes of the pole parts 104*a* and 104*b* and/or grooves, edges, and other forms of grips along the pole part 104 may similarly allow for better twisting/turning motions. In some embodiments, the use of supplemental grips that are not implemented and/or designed into the pole part 104 may be utilized. Use of various materials for supplemental grips, which may be attached to (e.g., directly attached to) the pole part 104, may include plastic, rubber, cloth, gel-foam, cushion, and/or the like, but are not limited to such materials. In other embodiments, the handle part 106 may be attached to the pole part 104, and is not limited to via welding, bolting, or screws, which may be relatively permanent in an affixed position. In other embodiments, the handle part 106 may be temporary/transient in its connection, whether by assembly required with detachment or by partial connections (which are not limited to plates or hinges) that allow for transitions between active use and passive storage. For example, in some embodiments, the handle part 106 may include flexible hinges, locking pins that are inserted into the handle part 106 with openings that are aligned with the overall structure in a lateral/transverse plane. In some embodiments, a flexible plated hinge and/or a locking pin may be used to secure a suitable position and/or orientation of the handle part 106.

Figure 3A:
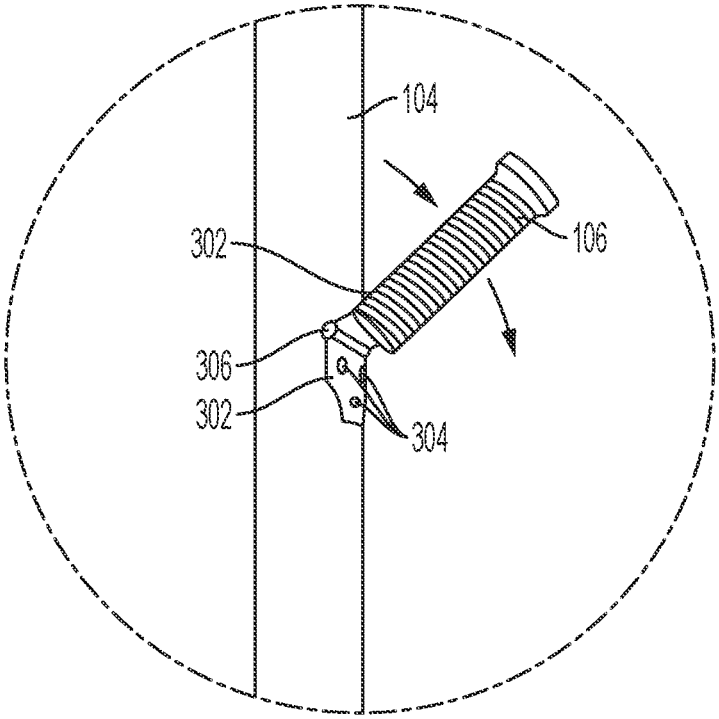
FIGS. 3A-3D are partial views of a handle part according to one or more embodiments of the present disclosure.

Referring to FIG. 3A, in some embodiments, the handle part 106 may be moved from a first position in which the handle part 106 is parallel to or substantially parallel to the pole part 104 and a second position in which the handle part 106 is perpendicular to or substantially perpendicular to the pole part 104. The handle part 106 may be used to rotate the pole part 104 when in the second position, for example, by being extended downward into a lateral/transverse plane for better use. For example, the handle part 106 may be connected to the pole part 104 via a plate part 302, which may be stabilized on the pole part 104 via openings formed therein that are aligned with corresponding openings formed in the pole part 104, and small screws 304, bolts, or the like that are inserted into the openings, but the present disclosure is not limited to. The handle part 106 may be connected to the plate part 302 via a hinge 306. The hinge 306 may allow for both collapsible/vertical plane and also deployed transverse/horizontal position for use of the handle part 106 to rotate the ground engagement structure 108.

Figure 3B:
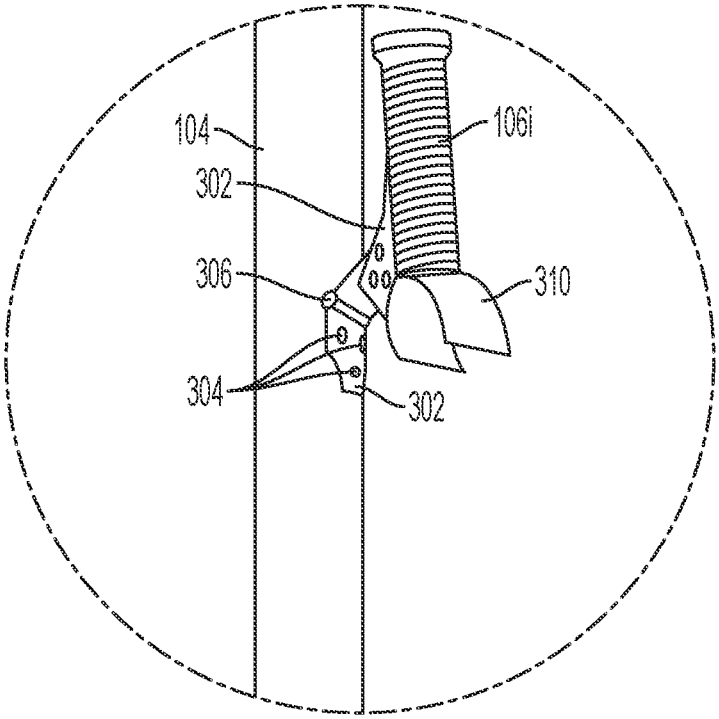

Referring to FIG. 3B, in some embodiments, the handle part 106*i* may further include end grasping members 310 to allow for further stability when in the second position (e.g., the transverse/deployed position). For example, when the handle part 106*i* is moved to the second position, the end grasping members 310 may be outwardly flexed and then may return towards a resting position to grasp around a circumference of the pole part 104. In this case, increased stability may be provided, and the handle part 106*i* may be prevented from being easily moved back to the first position. In FIG. 3B, the handle part 106*i* is illustrated in the first position (e.g., in an upward folded position) for better storage, but can be moved via the hinge 306 downward into the second position (e.g., the transverse/horizontal position) and temporarily locked in the second position relative to the pole part 104 via the end grasping members 310 to have a more secure connection with the pole part 104.

Figure 3C:
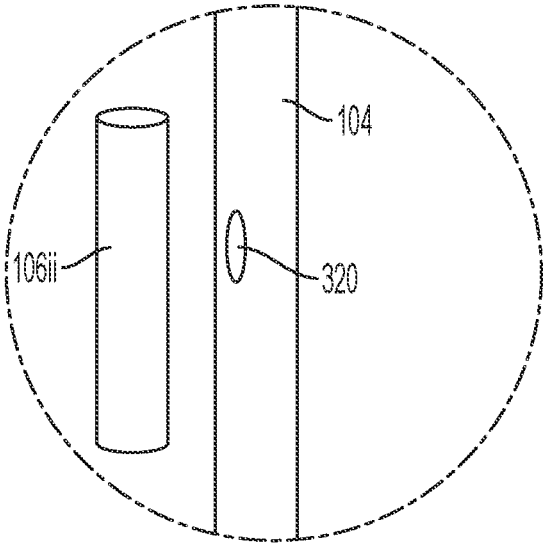
Figure 3D:
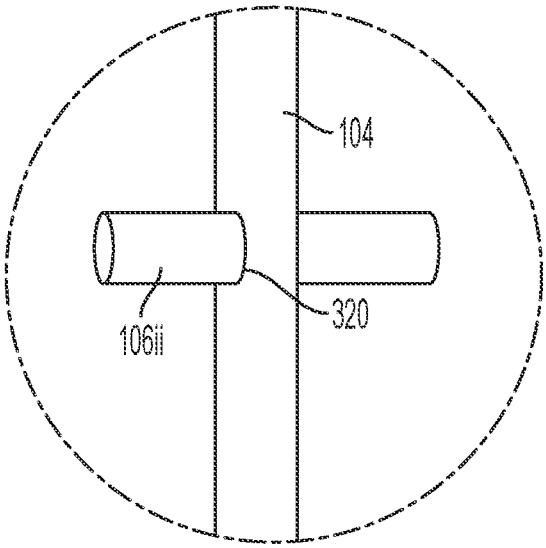

Referring to FIGS. 3C and 3D, the handle part 106*ii* may be detachable from the pole part 104. For example, the handle part 106*ii* may have a form fitting shape that may be inserted into a corresponding mating shape of an opening 320 formed in the pole part 104. Once inserted, whether partial or completely to midline, the handle part 106*ii* may be used to apply a rotational force to the ground engagement structure 108. The shapes of the pole part 106*ii* and the corresponding opening 320 are not limited to the circle shape shown in FIG. 3C, and may include any suitable form-fitting shapes, for example, such as an elliptical, a triangle, a curvilinear triangle, a rhombus, a square, a rectangle, a pentagon, a hexagon, a heptagon, a octagon, a nonagon, or the like. The removability of the handle part 106*ii* may also allow for better portability and transportation of the umbrella 100.

FIGS. 4A-4E are partial views of a ground engagement structure according to one or more embodiments of the present disclosure. The ground engagement structure 108 may be formed on at least a portion of the pole part 104, or may be connected to the pole part 104 to facilitate the user with implanting the umbrella 100 into the ground. For example, the ground engagement structure 104 may be rotated (e.g., via a rotational force applied to the pole part 104) in a first rotational direction with respect to the central axis C to burrow deeper into the ground. In some embodiments, a second rotational direction opposite to the first rotational direction may retract or release the ground engagement structure 108 from the ground.

In more detail, referring to FIGS. 4A through 4E, in various embodiments, the ground engagement structure 108 may include a material shifting structure MSS, and a material receiving groove MRG adjacent to the material shifting structure MSS. As the ground engagement structure 108 is rotated, the material shifting structure MSS may shift or otherwise displace ground material to burrow into or otherwise traverse through the ground. In some embodiments, the material shifting structure MSS may have a width (e.g., in the second direction) that is greater than a width of the pole part 104 in the second direction. In other words, in some embodiments, the material shifting structure MSS may extend radially relative to the pole part 104 from the second end of the pole part 104, but the present disclosure is not limited thereto.

The material receiving groove MRG may receive the ground material displaced by the material shifting structure MSS, and may transport or otherwise further displace the ground material away from the ground engagement structure 108. For example, the material receiving groove MRG may form a recess or a channel for the displaced ground material to be moved away from an engagement end or an engagement tip of the ground engagement structure 108. The material receiving groove MRG may be adjacent to the material shifting structure MSS, and may be formed between portions of the material shifting structure MSS.

Figure 4A:
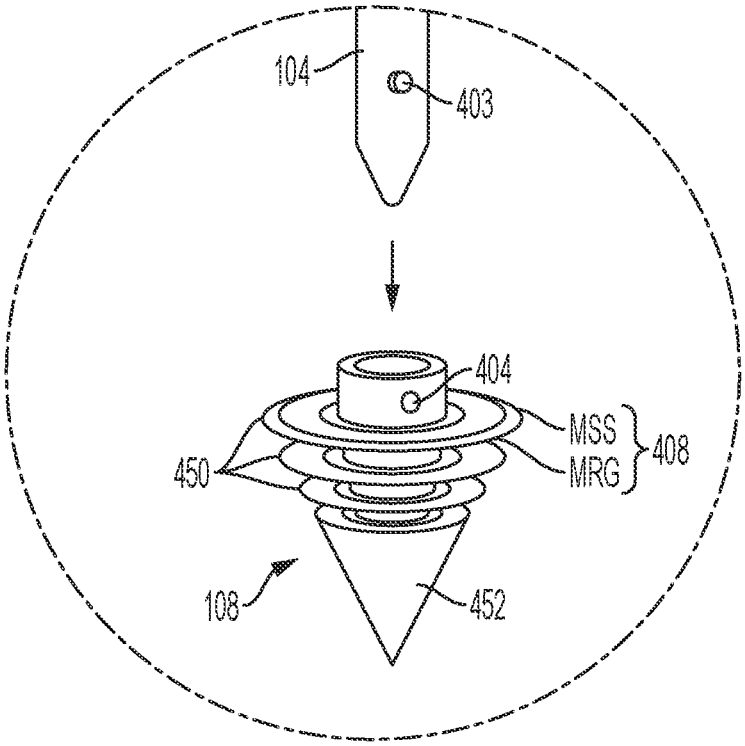
FIGS. 4A-4E are partial views of a ground engagement structure according to one or more embodiments of the present disclosure.
Figure 4B:
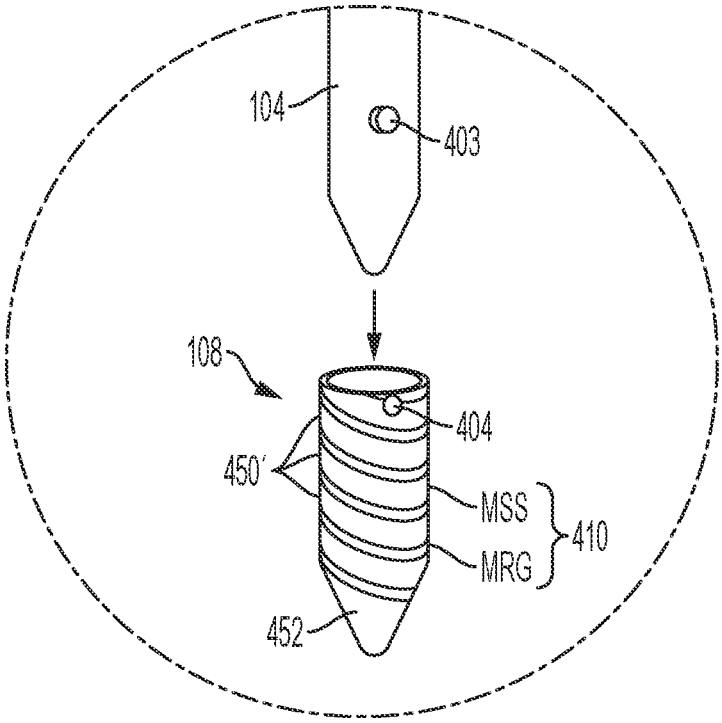
Figure 4C:
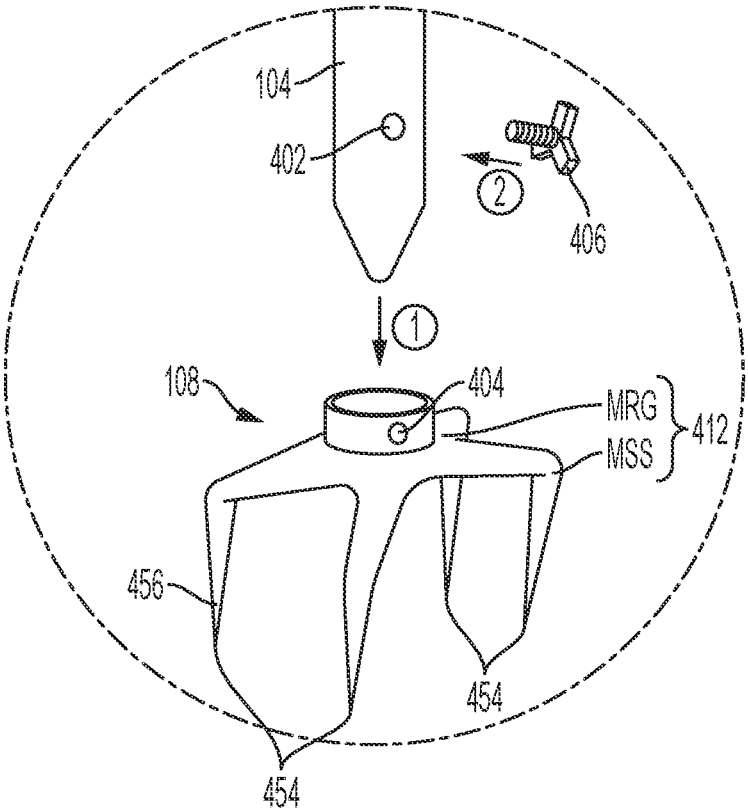
Figure 4D:
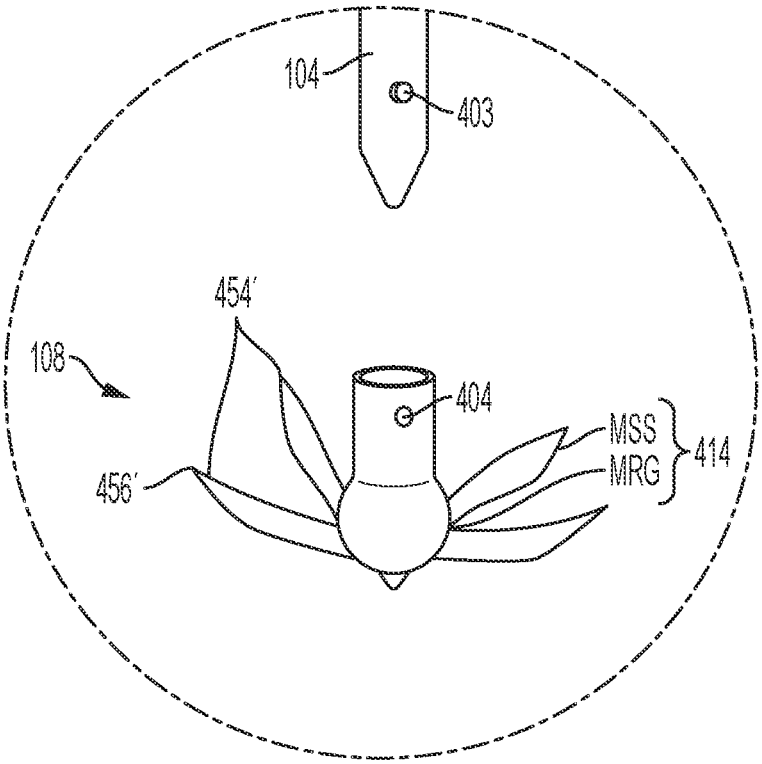
Figure 4E:
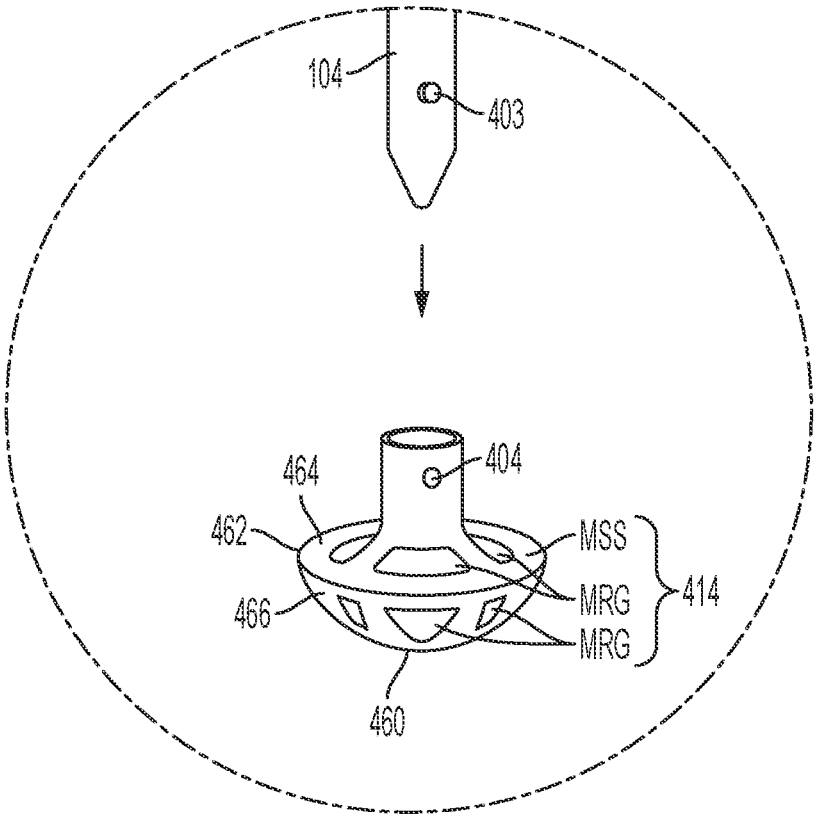

Various examples of the ground engagement structure 108 will now be described in more detail with reference to FIGS. 4A-4E. For example, in some embodiments, as shown in FIGS. 4A and 4B, the ground engagement structure 108 may include a threaded or drill-type base (e.g., an auger-type base 408 as shown in FIG. 4A, a carbide drill-type base 410 as shown in FIG. 4B, or the like). As another example, in some embodiments, as shown in FIG. 4C, the ground engagement structure 108 may include a tiller-type base 412. As another example, in some embodiments, as shown in FIGS. 4D and 4E, the ground engagement structure 108 may include an anchor-type base (e.g., a grapple anchor-type base 414 as shown in FIG. 4D, a mushroom anchor-type base 416 as shown in FIG. 4E, or the like). However, the present disclosure is not limited to the examples shown in FIGS. 4A-4E, and the ground engagement structure 108 may be implemented with various suitable types of bases, for example, including but not limited to Auger/cork screw-type bases, Mushroom-shaped anchor bases, Grapnel-shaped bases, Plough-shaped bases that may utilize one or more of flukes, hooks, claws, or scoops, and/or the like.

In more detail, referring to FIGS. 4A and 4B, in some embodiments, the material shifting structure MSS may extend radially relative to the pole part 104 from the second end of the pole part 104, and may be a threaded structure formed on at least a portion of the pole part 104 at the second end, or connected to the second end of the pole part 104. In some embodiments, the material receiving groove MRG may be adjacent to and formed between portions of the threaded structure, for example, such as a channel extending between threads 450 or 450' of the material shifting structure MSS.

In some embodiments, as shown in FIG. 4A, widths of the threads 450 of the material shifting structure MSS may increase from an engagement tip or end 452 towards the pole part 104. However, the present disclosure is not limited thereto, and in other embodiments, as shown in FIG. 4B, the widths of the threads 450' may be constant or substantially constant along a length of the material shifting structure MSS.

Referring to FIGS. 4C and 4D, in some embodiments, the material shifting structure MSS may extend radially relative to the pole part 104 from the second end of the pole part 104, and may include a plurality of arms 454 or 454' that extend radially relative to the pole part 104 from the second end of the pole part. The arms 454 or 454' may be spaced apart from each other by the material receiving groove MRG.

In some embodiments, as shown in FIG. 4C, each of the arms 454 may extend radially relative to the pole part 104 from the second end of the pole part 104, and may be bent or curved such that a tip 456 of the arms 454 extend (e.g., point) away from the second end of the pole part 104. In some embodiments, as shown in FIG. 4D, each of the arms 454' may extend radially relative to the pole part 104 from the second end of the pole part 104, and may be bent or curved such that a tip 456' of the arms 454' extend (e.g., point) towards the first end (e.g., the umbrella part end) of the pole part 104.

Referring to FIG. 4E, in some embodiments, the material shifting structure MSS may extend radially relative to the pole part 104 from the second end of the pole part 104, and may be formed to have a shape similar to a shape of an upside down mushroom. For example, the material shifting structure MSS may have a hemispherical shape having a diameter that increases from an engagement tip or end 460 towards the pole part 104 to a lip 462 of the material shifting structure MSS. The lip 462 may form an edge where an upper surface 464 of the material shifting structure MSS meets or is otherwise connected to a lower curved surface 466 of the material shifting structure MSS. The material receiving groove MRG may be formed to be adjacent to the material shifting structure MSS, for example, as a channel extending through the lower curved surface 466 and the upper surface 464 of the material shifting structure MSS.

In some embodiments, as shown in FIGS. 4A through 4E, the ground engagement structure 108 may be detachably connected to the pole part 104 (e.g., the second end of the pole part 104 or the second pole part 104*b*). For example, in some embodiments, as shown in FIG. 4A, the pole part 104 may further include a spring-loaded protrusion or button member 403 that protrudes from a surface of the pole part 104 at a distance from the second end to engage a connection hole 404 formed in the engagement structure 108. As another example, in some embodiments, as shown in FIG. 4B, the pole part 104 may further include an engagement hole 402 formed in a surface of the pole part 104 at a distance from the second end to be aligned with the connection hole 404 formed in the engagement structure 108, and fixed therewith via a fixation member 406, for example, such as a screw. However, the present disclosure is not limited thereto, and the ground engagement structure 108 may be integrally formed with at least a portion of the pole part 104 adjacent to the second end, or may be welded to, bolted to, screwed on, or otherwise attached to the pole part 104 at the second end such that the ground engagement structure 108 may not be easily detached from the pole part 104.

Although some embodiments have been described, those skilled in the art will readily appreciate that various modifications are possible in the embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific embodiments disclosed herein, and that various modifications to the disclosed embodiments, as well as other example embodiments, are intended to be included within the spirit and scope of the present disclosure as defined in the appended claims, and their equivalents.

What is claimed is:

1. An umbrella comprising:

a pole part having a first end, a second end opposite the first end, and a pole axis extending through the first end and the second end;

an umbrella part at the first end; and a ground engagement structure extending from the second end for engaging a ground, comprising:

a material shifting structure extending radially relative to the pole part; and a material receiving groove adjacent to the material shifting structure, wherein the material shifting structure comprises:

an upper surface facing the pole part;

a lower curved surface opposite the upper surface, and defining an engagement end; and a lip connecting the upper surface to the lower surface, wherein the lower curved surface has a width that increases from the engagement end towards the upper surface, and wherein the material receiving groove is a channel extending through the lower curved surface and the upper surface of the material shifting structure.

2. The umbrella of claim 1, wherein the pole part comprises a first pole part including the umbrella part and a second pole part including the ground engagement structure.

3. The umbrella of claim 2, wherein the first pole part is slidably connected with the second pole part.

4. The umbrella of claim 3, wherein:

the first pole part comprises the first end of the pole part, a third end opposite the first end, and an elongated body extending between the first and third ends;

the second pole part comprises the second end of the pole part, a fourth end opposite the second end, and a tubular body extending between the second and fourth ends; and the third end is insertable into the fourth end such that at least a portion of the first pole part is received in the second pole part.

5. The umbrella of claim 1, further comprising a handle part connected to the pole part.

6. The umbrella of claim 5, wherein the handle part is hingedly connected to the pole part.

7. An umbrella comprising:

a pole part having a first end, a second end opposite the first end, and a pole axis extending through the first end and the second end, the pole part comprising:

a first pole part comprising the first end, a third end opposite the first end, and an elongated body extending between the first and third ends; and a second pole part comprising the second end, a fourth end opposite the second end, and a tubular body extending between the second and fourth ends;

an umbrella part at the first end; and a ground engagement structure extending from the second end for engaging a ground, comprising:

a material shifting structure extending radially relative to the pole part; and a material receiving groove adjacent to the material shifting structure, wherein the third end of the first pole part is insertable into the tubular body via the fourth end of the second pole part, wherein the material shifting structure comprises:

an upper surface facing the pole part;

a lower curved surface opposite the upper surface, and defining an engagement end; and a lip connecting the upper surface to the lower surface, wherein the lower curved surface has a width that increases from the engagement end towards the upper surface, and wherein the material receiving groove is a channel extending through the lower curved surface and the upper surface of the material shifting structure.

* * * * *